US010278474B2

(12) United States Patent
Moon

(10) Patent No.: US 10,278,474 B2
(45) Date of Patent: May 7, 2019

(54) COSMETIC CONTAINER

(71) Applicant: INTERWORK KOREA CO., LTD., Siheung-si (KR)

(72) Inventor: Hyun Myung Moon, Yongin (KR)

(73) Assignee: INTERWORK KOREA CO., LTD., Siheung-si (KR)

( * ) Notice: Subject to any disclaimer, the term of this patent is extended or adjusted under 35 U.S.C. 154(b) by 315 days.

(21) Appl. No.: 15/196,158

(22) Filed: Jun. 29, 2016

(65) Prior Publication Data

US 2017/0006999 A1 Jan. 12, 2017

(30) Foreign Application Priority Data

Jul. 7, 2015 (KR) ..... 10-2015-0096618

(51) Int. Cl.
*A45D 34/04* (2006.01)

(52) U.S. Cl.
CPC ..... *A45D 34/04* (2013.01); *A45D 34/045* (2013.01)

(58) Field of Classification Search
CPC .... A45D 34/04; A45D 34/045; A45D 34/046; B01L 3/021; B01L 3/0217; B01L 3/0224; B01L 3/0282; G01F 11/021; G01F 11/023; G01F 11/024; G01F 11/025; G01F 11/028
See application file for complete search history.

(56) References Cited

U.S. PATENT DOCUMENTS

2009/0120963 A1* 5/2009 Bae ..... B05B 11/0032 222/153.13
2013/0192713 A1* 8/2013 Drugeon ..... A45D 34/04 141/26
2013/0256338 A1* 10/2013 Moreau ..... B05B 11/0029 222/153.14
2015/0257510 A1* 9/2015 Kim ..... A45D 34/041 401/126

FOREIGN PATENT DOCUMENTS

KR 20-0471502 2/2014
KR 20-0474769 10/2014
WO WO 2014054882 * 4/2014

* cited by examiner

*Primary Examiner* — Andrew StClair
(74) *Attorney, Agent, or Firm* — Lex IP Meister, PLLC

(57) ABSTRACT

Disclosed is a dropper type of cosmetic container that may be conveniently used by sucking liquid cosmetics through a dropper tube and then discharging the liquid cosmetics to the outside through the dropper tube.
An exemplary embodiment of the present invention provides a cosmetic container including a container, an internal cap combined with the container, an external cap combined with the outside of the internal cap, a dropper tube combined with the internal cap, a button disposed between the outside of the internal cap and the inside of the external cap, a piston combined with the button, and an elastic member disposed between the internal cap and the button, wherein an external circumferential surface of the internal cap may be provided with a guide groove in which the button is guided in a spiral direction and simultaneously fitted, and an interior circumferential surface of the button may be provided with a guide protrusion that is fitted in the guide groove to lift or lower the button or to rotate and move the button.

4 Claims, 8 Drawing Sheets

COSMETIC CONTAINER

CROSS-REFERENCE TO RELATED APPLICATION

This application claims priority to and the benefit of Korean Patent Application No. 10-2015-0096618 filed in the Korean Intellectual Property Office on Jul. 7, 2015, the entire contents of which are incorporated herein by reference.

BACKGROUND OF THE INVENTION (a) Field of the Invention

The present invention relates to a dropper type of cosmetic container that may be conveniently used by sucking liquid cosmetics through a dropper tube and then discharging the liquid cosmetics to the outside through the dropper tube.

(b) Description of the Related Art

Generally, since a dropper type of cosmetic container is configured to suck and discharge liquid cosmetics contained in the container through a dropper tube, it may be conveniently used. Such a cosmetic container is disclosed in Korean registration utility model publication No. 20-0471502. The cosmetic container disclosed in Korean registration utility model publication No. 20-0471502 includes a container in which cosmetics are contained, a dropper tube accommodated in the container, an internal cap combined with the container, an external cap combined with the internal cap, a retractable button disposed inside the external cap, and a spring for returning the retractable button to an initial position.

In the cosmetic container, the external cap is assembled to the internal cap in a state in which the internal cap is combined with the container and the spring and the retractable button are fitted inside the external cap. In this case, while holding the external cap and the retractable button with one hand and holding the container with the other hand to keep the retractable button disposed at a normal position of the external cap, a worker fits the external cap including the retractable button into the internal cap. In this process, the position of the retractable button may be wrongly fitted according to proficiency of the worker. As such, since the cosmetic container is manually assembled, high proficiency of the workers is required, and when a large number of cosmetic containers are assembled, productivity may decrease such that man-hours for assembling increases.

PRIOR ART DOCUMENT

Patent Document (Patent Document 1) Korean registration utility model publication No. 20-0471502 (2014 Feb. 20)

SUMMARY OF THE INVENTION

The present invention has been made in an effort to provide a cosmetic container that may improve assembling efficiency to easily assemble the cosmetic container without high proficiency of a worker, which may reduce man-hours and production costs.

An exemplary embodiment of the present invention provides a cosmetic container including a container, an internal cap combined with the container, an external cap combined with the outside of the internal cap, a dropper tube combined with the internal cap, a button disposed between the outside of the internal cap and the inside of the external cap, a piston combined with the button, and an elastic member disposed between the internal cap and the button, wherein an external circumferential surface of the internal cap may be provided with a guide groove in which the button is guided in a spiral direction and simultaneously fitted, and an interior circumferential surface of the button may be provided with a guide protrusion that is fitted in the guide groove to lift or lower the button or to rotate and move the button.

The guide groove may be formed by engraving, and may include an entrance portion into which the guide protrusion is inserted, a first guide portion that extends from the entrance portion in a direction parallel to an axis of the cosmetic container, a second guide portion that extends from the first guide portion in a circumferential direction, a spiral portion formed to connect one end of the second guide portion to the entrance portion, and a button fitting groove in which one end of the second guide portion and one end of the spiral portion extend and in which the button is fitted.

The entrance portion may be disposed toward the direction parallel to the axis, and may be opened in a direction opposite to that of the container.

The second guide portion may be disposed at the container side, and the spiral portion may be disposed at a side opposite to the container.

The button fitting groove may be formed along a circumferential direction of the internal cap.

According to the embodiment of the present invention, since the external cap is fixed to the internal cap after the button is fitted into the button fitting groove of the guide groove provided with the internal cap, it is possible to conveniently assemble the cosmetic container and for even unskilled workers to easily assemble the cosmetic container, thereby reducing the production costs.

DETAILED DESCRIPTION OF THE EMBODIMENTS

Figure 1:
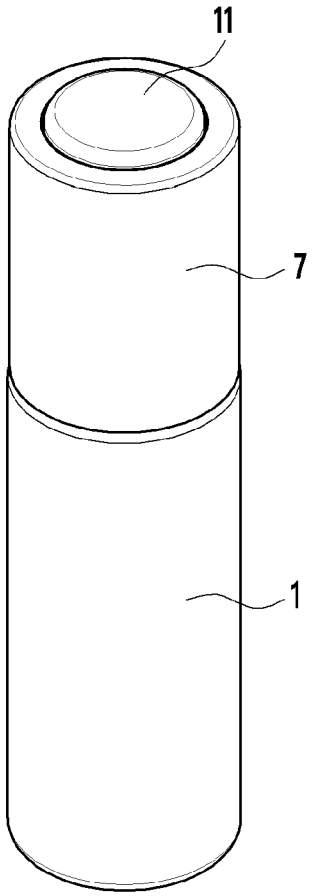
FIG. 1 illustrates a perspective view of an outer shape of a cosmetic container according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
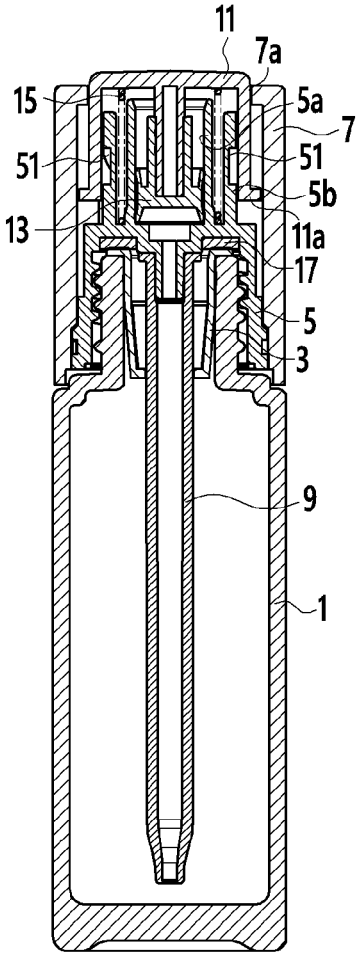
FIG. 2 illustrates a cross-sectional view of the cosmetic container of FIG. 1 with respect to a longitudinal direction.
Figure 3:
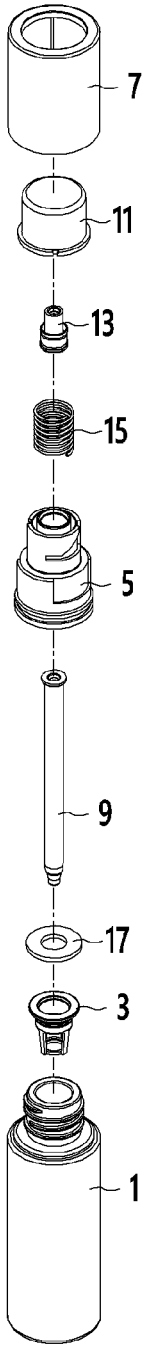
FIG. 3 illustrates an exploded perspective view of FIG. 1.

FIG. 1 illustrates a perspective view of an outer shape of a cosmetic container according to an exemplary embodiment of the present invention, FIG. 2 illustrates a cross-sectional view of the cosmetic container of FIG. 1 with respect to a longitudinal direction, and FIG. 3 illustrates an exploded perspective view of FIG. 1.

A cosmetic container according to an exemplary embodiment of the present invention includes a container 1, a wiper 3, an internal cap 5, an external cap 7, a dropper tube 9, a button 11, a piston 13, and an elastic member 15.

Figure 4:
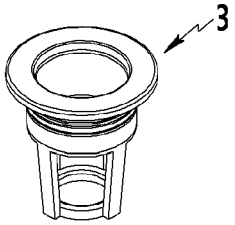
FIG. 4 illustrates a perspective view of a wiper applied to an exemplary embodiment of the present invention.

Liquid cosmetics are accommodated in the container 1. It is preferable that threads for fixing the internal cap 5 are provided on an outer side of an entrance of the container 1. It is preferable that the wiper 3 is disposed at an inner side of the entrance of the container 1 (refer to FIG. 3 and FIG. 4).

When the dropper tube 9 is drawn out of the container 1, the wiper 3 serves to wipe the liquid cosmetics remaining on an outer surface of the dropper tube 9.

The internal cap 5 may be engaged with the threads provided on the outer side of the entrance of the container 1. That is, thread grooves corresponding to the threads provided on the outer side of the entrance of the container 1 described above are provided on some of the inside of the internal cap 5. The internal cap 5 is formed to have a central through-portion. A portion toward the container 1 from the central through-portion of the internal cap 5 protrudes to be coupled with the dropper tube 9. Some of the central through-portion of the internal cap 5 forms a cylinder portion 5*a*.

The elastic member 15 is disposed in the vicinity of an external circumferential side of the cylinder portion 5*a* of the internal cap 5. The elastic member 15 may be formed of a compression coil spring, and it is disposed to apply elastic force between the internal cap 5 and the button 11, thus the elastic force thereof is applied so that the button 11 is away from the internal cap 5 in the axial direction.

In the internal cap 5, an external circumferential surface 5*b* of a cylindrical shape is formed in a radial direction at a position spaced apart from the outside of the cylinder portion 5*a* by a predetermined distance. A guide groove 51 into which the button 11 is fitted is provided on the external circumferential surface 5*b* of the internal cap 5. A detailed description of the guide groove 51 will be given later.

Threads may be provided on some of an external circumferential surface of the internal cap 5 of the container 1 side to be coupled with the external cap 7.

Figure 9:
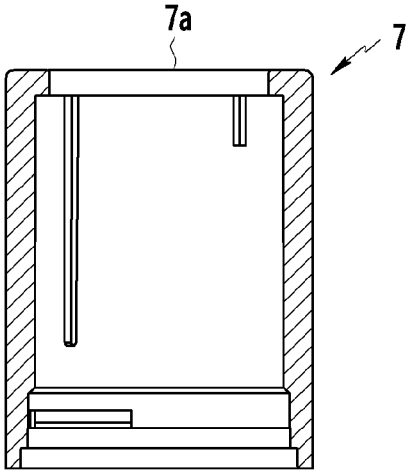
FIG. 9 illustrates a cross-sectional view of an external cap according to an exemplary embodiment of the present invention with respect to an axial direction.
Figure 10:
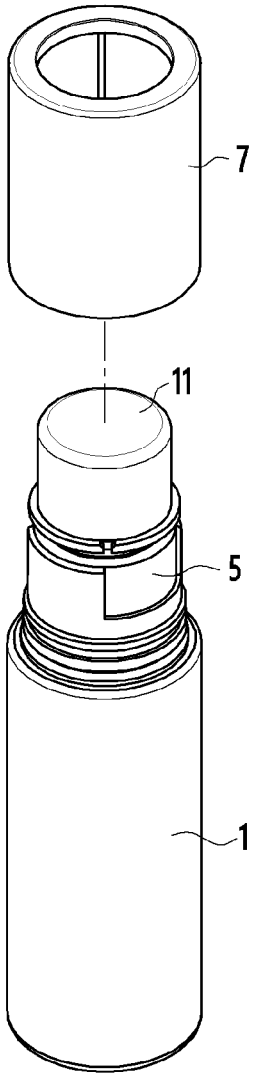
FIG. 10 illustrates a state in which a button is fixed to an internal cap and is separated from an external cap in an exemplary embodiment of the present invention.

Of course, it is preferable that thread grooves corresponding to the threads of the internal cap 5 are provided on an interior circumferential surface of the external cap 7. A hole 7*a* into which the button 11 is inserted is provided in a central portion of the external cap 7 in an opposite direction to that of the container 1 (refer to FIG. 9).

Figure 7:
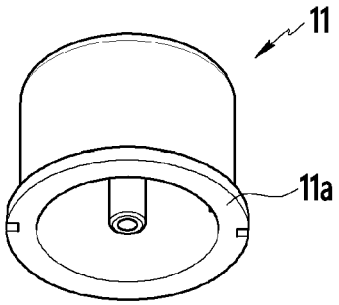
FIG. 7 illustrates a bottom perspective view of a button according to an exemplary embodiment of the present invention.
Figure 8:
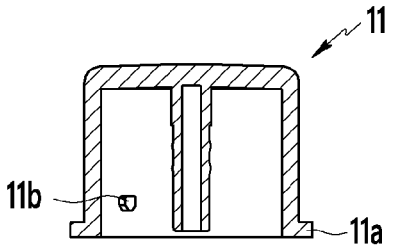
FIG. 8 illustrates a cross-sectional view of the button of FIG. 7 with respect to an axial direction.

The piston 13 is combined with a central portion of the button 11. The piston 13 serves to cause the dropper tube 9 to suck or discharge the liquid cosmetics while moving along the cylinder portion 5*a* of the internal cap 5. As shown in FIG. 7 and FIG. 8, a flange 11*a* is provided at a portion of the button 11 toward the container 1. When the button 11 moves in an axial central direction through the hole 7*a* provided in the external cap 7, the flange 11*a* of the button 11 serves to not allow the button 11 to separate from the external cap 7.

A guide protrusion 11*b* is provided at the inside of the button 11. The guide protrusion 11*b* provided at the button 11 may be fitted in the guide groove 51 of the internal cap 5. It is preferable that the guide protrusion 11*b* protrudes to have a predetermined length in a direction parallel to the axis.

Alternatively, a packing 17 that can prevent the liquid cosmetics from leaking from the container 1 may be provided between the internal cap 5 and the container 1 or the wiper 3 combined with the container 1.

Figure 5:
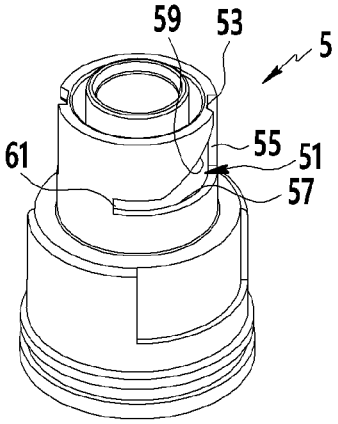
FIG. 5 illustrates a perspective view of an internal cap according to an exemplary embodiment of the present invention.
Figure 6:
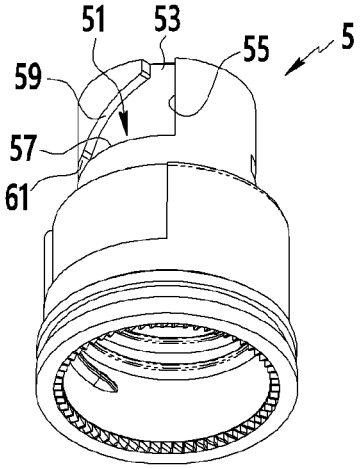
FIG. 6 illustrates a bottom perspective view of an internal cap according to an exemplary embodiment of the present invention.

The guide groove 51 provided on the external circumferential surface of the internal cap 5 is formed as an engraved groove. As shown in FIG. 5 and FIG. 6, the guide groove 51 include an entrance portion 53, a first guide portion 55, a second guide portion 57, a spiral portion 59, and a button fitting groove 61.

The entrance portion 53 is a portion into which the guide protrusion 11*b* of the button 11 is inserted. It is preferable that the entrance portion 53 is formed to have a shape that is opened in a direction parallel to a center line of the axis at the side opposite to the container 1.

The first guide portion 55 extends from the entrance portion 53 to be provided in a direction parallel to the center line of the axis. The second guide portion 57 extends from the first guide portion 55 to be formed in a predetermined range along the external circumferential surface of the internal cap 5. The spiral portion 59 extends from one end of the second guide portion 57 to the entrance portion 53 to have a spiral shape. The button fitting groove 61 may consist of a groove in which one end of the second guide portion 57 and one end of the spiral portion 59 extend along a circumferential direction of the internal cap 5.

An inner portion formed by the entrance portion 53, the first guide portion 55, the second guide portion 57, the spiral portion 59, and the button fitting groove 61 forms the groove.

In the exemplary embodiment of the present invention, it is preferable that the second guide portion 57 is disposed at the container 1 side, and that the spiral portion 59 is disposed at the side opposite to the container 1.

An assembling process of the exemplary embodiment of the present invention described above will now be described in detail.

First, the wiper 3 is fitted in and combined with the inside of the container 1. Then, the dropper tube 9 is combined to the central portion of the internal cap 5. The packing 17 is then fixed to the internal cap 5. The packing 17 is fixed to the internal cap 5 so as to be able to be disposed on a surface at which the entrance of the container 1 or the wiper 3 and the internal cap 5 contact. Subsequently, the piston 13 is fixed to the central portion of the button 11. The elastic member 15 is installed at the internal cap 5, and then the button 11 is fitted in the internal cap 5.

In this case, the guide protrusion 11*b* provided inside the button 11 moves in the axis direction along the first guide portion 55 through the entrance portion 53 of the internal cap 5. In such a state, when the button 11 is relatively rotated with respect to the internal cap 5, the guide protrusion 11*b* of the button 11 moves along the second guide portion 57 to be inserted into the button fitting groove 61. That is, the button 11 is fixed to the internal cap 5. In such a state, the external cap 7 is fixed to the internal cap 5. Then, the external cap 7 to which the internal cap 5 is fixed is combined with the container 1.

Alternatively, after the internal cap 5 is first combined with the container 1, the button 11 may be combined with the external cap 7 according to the process order described above.

In the cosmetic container according the exemplary embodiment of the present invention assembled as described above, when the external cap 7 is turned in a direction to be opened from the container 1, the elastic member 15 presses the button 11, such that the guide protrusion 11*b* of the button 11 moves along the spiral portion 59 of the internal cap 5. Then, the piston 13 moves along the cylinder portion 5*a* in an opposite direction to the dropper tube 9. In this case, the liquid cosmetics contained in the container 1 move along the dropper tube 9 by a negative pressure of the inside of the dropper tube 9 to fill the dropper tube 9.

Subsequently, a user turns the external cap 7 such that the external cap 7 and the internal cap 5 are separated from each other in the container 1. Then, when the user presses the button 11, the elastic force of the elastic member 15 of the piston 13 is overcome, thus the button 11 moves in the direction of the dropper tube 9 along the cylinder portion 5*a*. Accordingly, the liquid cosmetics contained in the dropper tube 9 may be discharged to the outside by an internal pressure thereof.

According to the exemplary embodiment of the present invention, after the button 11 is combined with the internal cap 5 together with the elastic member 15, since the external cap 7 may be combined with the internal cap 5, it is possible to reduce the man-hours for assembling and the production costs of the cosmetic container. Moreover, according to the exemplary embodiment of the present invention, even unskilled workers may easily assemble the cosmetic container, thereby reducing the production costs.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

1. container,
3. wiper,
5. internal cap, 5*a*. cylinder portion, 5*b*. external circumferential surface,
7. external cap, 7*a*. hole,
9. dropper tube,
11. button, 11*a*. flange, 11*b*. guide protrusion,
13. piston,
15. elastic member,
17. packing,
51. guide groove,
53. entrance portion,
55. first guide portion,
57. second guide portion,
59. spiral portion,
61. button fitting groove

What is claimed is:

1. A cosmetic container comprising:
a container;
an internal cap combined with the container;
an external cap combined with an outside of the internal cap;
a dropper tube combined with the internal cap;
a button disposed between the outside of the internal cap and an inside of the external cap;
a piston combined with the button; and
an elastic member disposed between the internal cap and the button,
wherein an upper portion of the internal cap comprises a cylinder portion,
wherein an external circumferential surface of the cylinder portion of the internal cap is provided with a guide groove in which the button is guided in a spiral direction,
wherein an interior circumferential surface of the button is provided with a guide protrusion that is fitted in the guide groove to lift or lower the button or to rotate and move the button, and
wherein the guide groove is formed by engraving, and includes,
an entrance portion disposed at an upper end of the cylinder portion of the internal cap and into which the guide protrusion is inserted,
a first guide portion that extends from the entrance portion in a direction parallel to an axis of the cosmetic container and terminates at a lower end of the of the cylinder portion of the internal cap,
a second guide portion that extends from the first guide portion in a circumferential direction,
a spiral portion formed to connect one end of the second guide portion to the entrance portion, and
a button fitting groove disposed at the lower end of the cylinder portion of the internal cap and in which one end of the second guide portion and one end of the spiral portion extend and in which the button can be fitted,
wherein the external cap and the button are configured such that when the external cap is turned in a direction to be opened from the container, the guide protrusion moves along the spiral portion of the guide groove as the button is pressed by the elastic member, which moves the piston in a direction away from the dropper tube.

2. The cosmetic container of claim 1, wherein
the entrance portion is disposed toward the direction parallel to the axis and is opened in a direction opposite to that of the container.

3. The cosmetic container of claim 1, wherein the second guide portion is disposed at a side of the cylinder portion of the internal cap adjacent the container, and the spiral portion is disposed at a side of the cylinder portion opposite to the container.

4. The cosmetic container of claim 1, wherein
the button fitting groove is formed along a circumferential direction of the internal cap.

* * * * *